US009844239B2

(12) United States Patent
Plain

(10) Patent No.: US 9,844,239 B2
(45) Date of Patent: Dec. 19, 2017

(54) SOLAR POWERED PORTABLE PERSONAL COOLING SYSTEM WITH DUAL MODES OF OPERATION

(71) Applicant: John O. Plain, Park Ridge, NJ (US)

(72) Inventor: John O. Plain, Park Ridge, NJ (US)

( * ) Notice: Subject to any disclaimer, the term of this patent is extended or adjusted under 35 U.S.C. 154(b) by 42 days.

(21) Appl. No.: 14/790,715

(22) Filed: Jul. 2, 2015

(65) Prior Publication Data

US 2016/0015113 A1 Jan. 21, 2016

Related U.S. Application Data

(60) Provisional application No. 62/025,293, filed on Jul. 16, 2014.

(51) Int. Cl.

| | |
|---|---|
| ***A42B 3/28*** | (2006.01) |
| ***A42B 1/00*** | (2006.01) |
| ***F04D 25/06*** | (2006.01) |
| ***F04D 25/08*** | (2006.01) |

(52) U.S. Cl.

CPC ..... *A42B 3/286* (2013.01); *A42B 1/008* (2013.01); *F04D 25/0673* (2013.01); *F04D 25/084* (2013.01)

(58) Field of Classification Search

CPC ..... A42B 3/286; A42B 1/008
USPC ..... 136/245, 246
See application file for complete search history.

(56) References Cited

U.S. PATENT DOCUMENTS 3,881,198 A * 5/1975 Waters ..... A42B 3/286 2/171.3
4,149,903 A * 4/1979 Lindmayer ..... H01L 31/052 126/569
4,321,912 A * 3/1982 Larsen ..... F24J 2/20 126/625
4,551,857 A * 11/1985 Galvin ..... A42B 1/008 136/291
4,568,521 A * 2/1986 Spector ..... A61L 9/122 136/246
4,596,083 A * 6/1986 Thompson ..... G09F 19/02 136/246
4,672,968 A * 6/1987 Lenox ..... A41D 13/1209 2/171.3
4,680,815 A * 7/1987 Hirsch ..... A42C 5/04 2/171.3
4,824,013 A * 4/1989 Gouldey ..... G05D 23/275 174/58
4,827,534 A * 5/1989 Haugen ..... H01L 31/042 136/291

(Continued)

*Primary Examiner* — Jameson Collier
*Assistant Examiner* — Heather Mangine
(74) *Attorney, Agent, or Firm* — The McHattie Law Firm, LLC

(57) ABSTRACT

A device enables a wearer to obtain a personal zone of cooling effect. Specifically, a headwear is provided that incorporates a stabilizing and aerating platform to house and support an array of photo-voltaic cells that in turn power strategically placed and positionable personal variable speed fans. The device anticipates and counters the power decreases typically encountered by photo-voltaic cells when operating in elevated temperatures. The present invention, and also provides dual modality of use to provide a smaller photo-voltaic cell array in situations where a sacrifice in power is acceptable relative to a sizing of the device.

11 Claims, 16 Drawing Sheets

(56) References Cited

U.S. PATENT DOCUMENTS 4,858,627 A * 8/1989 Netschert ..... A24F 47/00 131/329
4,893,356 A * 1/1990 Waters ..... A42B 1/008 2/171.3
RE33,286 E * 8/1990 Waters ..... A42C 5/04 2/171.3
5,029,342 A * 7/1991 Stein ..... A61F 9/068 136/291
5,088,127 A * 2/1992 Thornock ..... A42B 1/004 2/195.1
5,250,265 A * 10/1993 Kawaguchi ..... A61L 9/122 136/246
5,425,620 A * 6/1995 Stroud ..... A42B 1/008 2/171.3
5,433,259 A * 7/1995 Faludy ..... B60P 3/343 136/245
5,541,816 A * 7/1996 Miserendino ..... A42B 1/244 362/106
5,561,862 A * 10/1996 Flores, Sr. ..... A42B 3/286 2/171.3
5,711,033 A * 1/1998 Green ..... A42B 3/286 2/171.3
5,785,280 A * 7/1998 Baghdasarian ..... B64G 1/222 136/245
5,855,692 A * 1/1999 Kaji ..... A45C 15/00 136/245
6,032,291 A * 3/2000 Asenguah ..... A42B 1/008 2/171.3
6,081,929 A * 7/2000 Rothrock ..... A42B 3/286 2/171.3
6,115,846 A * 9/2000 Truesdale ..... A42B 3/042 2/171.3
6,406,168 B1 * 6/2002 Whiting ..... A42B 3/0453 362/105
6,476,311 B1 * 11/2002 Lee ..... H02J 7/355 136/244
6,515,217 B1 * 2/2003 Aylaian ..... H01L 31/048 136/244
6,711,748 B2 * 3/2004 Paris ..... A41D 13/11 2/171.3
6,760,925 B1 * 7/2004 Maxwell ..... A42B 3/285 2/171.3
6,870,089 B1 * 3/2005 Gray ..... H01L 31/042 136/200
6,932,150 B1 * 8/2005 Yeh ..... A42B 3/285 165/104.21
7,003,353 B1 * 2/2006 Parkhouse ..... A42B 1/242 320/108
7,026,541 B2 * 4/2006 Heidrich ..... H02S 30/20 136/244
7,143,451 B2 * 12/2006 Lundgren ..... A42C 5/04 2/171.3
7,290,292 B1 * 11/2007 Nellon ..... A42C 5/04 2/171.3
7,331,064 B1 * 2/2008 Quintal ..... A42B 1/008 2/171.3
7,721,349 B1 * 5/2010 Strauss ..... A41D 13/0053 2/102
8,156,570 B1 * 4/2012 Hockaday ..... A41D 13/0025 2/7
8,230,685 B2 * 7/2012 Lin ..... H01L 31/042 136/245
8,234,722 B2 * 8/2012 VanDerWoude ... A41D 13/1153 2/410
8,336,113 B2 * 12/2012 Uttrachi ..... A61F 9/067 2/171.3
8,410,748 B2 * 4/2013 Wilson ..... H01M 10/465 136/251
8,480,365 B2 * 7/2013 Ochoa ..... F04D 25/0673 416/146 R
8,757,831 B2 * 6/2014 Waters ..... A42B 1/244 200/566
2005/0058317 A1 * 3/2005 Montgomery ..... H04R 5/023 381/376
2008/0130272 A1 * 6/2008 Waters ..... A42B 1/244 362/106
2008/0196758 A1 * 8/2008 McGuire ..... F03D 9/007 136/245
2008/0222777 A1 * 9/2008 Schneider ..... A42B 1/24 2/209.13
2009/0089917 A1 * 4/2009 Chen ..... A42B 3/30 2/422
2009/0126076 A1 * 5/2009 Ochoa ..... A42B 1/244 2/171.3
2011/0146751 A1 * 6/2011 McGuire ..... F03D 9/007 136/245
2011/0162690 A1 * 7/2011 Workman ..... H02S 30/20 136/245
2011/0216529 A1 * 9/2011 Weng ..... F21L 4/00 362/183
2011/0231977 A1 * 9/2011 Rupnick ..... A42B 3/286 2/7
2011/0259393 A1 * 10/2011 Lai ..... H02S 30/20 136/245
2011/0272001 A1 * 11/2011 Li ..... H02S 40/42 136/246
2011/0286620 A1 * 11/2011 Flynn ..... A42B 1/245 381/375
2011/0318197 A1 * 12/2011 Huber ..... A42B 3/286 417/234
2012/0073623 A1 * 3/2012 Jones ..... H01L 31/02013 136/245
2013/0033852 A1 * 2/2013 Liao ..... A42B 1/24 362/106
2013/0160195 A1 * 6/2013 Clement ..... A42B 3/286 2/437
2013/0285595 A1 * 10/2013 Eaton, Jr. ..... H01L 31/042 320/101
2014/0210609 A1 * 7/2014 Yang ..... A42B 3/0453 340/463
2014/0224302 A1 * 8/2014 Keenihan ..... H01L 31/0521 136/246
2014/0230114 A1 * 8/2014 Wilson, Jr. ..... A61F 9/045 2/13
2014/0238044 A1 * 8/2014 Lau ..... F25B 21/02 62/3.2
2014/0332058 A1 * 11/2014 Hong ..... H02S 30/10 136/251
2015/0027511 A1 * 1/2015 Jang ..... H01L 31/0521 136/246
2015/0059825 A1 * 3/2015 Swatek ..... F24J 2/5406 136/245
2015/0136201 A1 * 5/2015 Mariotto ..... F24J 2/085 136/246
2015/0143612 A1 * 5/2015 Noble ..... A42B 1/008 2/171.3
2015/0143613 A1 * 5/2015 Chu ..... A42B 1/008 2/171.3
2015/0365047 A1 * 12/2015 Swatek ..... H02S 30/20 136/245
2016/0015113 A1 * 1/2016 Plain ..... A42B 3/286 2/171.3
2016/0065126 A1 * 3/2016 Felgemacher ..... H02S 10/00 136/246
2016/0106174 A1 * 4/2016 Chung ..... A42B 3/0453 340/539.13

* cited by examiner

PLAIN

PLAIN

PLAIN

PLAIN

PLAIN

PLAIN

PLAIN

PLAIN

PLAIN

PLAIN

PLAIN

PLAIN

PLAIN

PLAIN

PLAIN

PLAIN

SOLAR POWERED PORTABLE PERSONAL COOLING SYSTEM WITH DUAL MODES OF OPERATION

This application claims priority to Provisional U.S. Patent Application Ser. No. 62/025,293 filed Jul. 16, 2014.

FIELD OF THE INVENTION

The present invention provides a device that provides the wearer a personal zone of cooling effect. Specifically, a headwear is provided that incorporates a stabilizing and aerating platform to house and support an array of photo-voltaic cells that in turn power strategically placed and positionable personal variable speed fans. The present invention also anticipates and counters the power decreases typically encountered by photo-voltaic cells when operating in elevated temperatures. The present invention also provides dual modality of use to provide a smaller photo-voltaic cell array in situations where a sacrifice in power is an acceptable trade off for a smaller footprint.

BACKGROUND

For centuries, mankind has looked to provide solutions to personal overheating. Modern air conditioning is quite sophisticated, but is only applicable in confined quarters such as an office, a home or a car. Moreover, despite its efficiencies, modern air conditioning still requires significant power consumption.

Hand held fans have been utilized for ages. Any large leaf or other flat, lightweight surface could suffice. Expanding paper or silk hand fans became popular for their ease of carrying and instantly unfolding into a suitable surface for the user to waft back and forth.

The earliest electric fans were introduced in around the 1880's. The first such fans were essentially a blade attached to an electric motor. These early fans were dangerous and expensive and generally had exposed blades and motors. Thereafter, motors were encased and fan cages appeared, but these fans were very cumbersome. As technology increased, fans became smaller, more efficient and provided design improvements, such as oscillation.

The present invention provides a personal cooling fan powered by solar energy in a dual configuration such that when a wearer is exposed to full sun and heat in an open environment, full capacity is achieved with a front facing adjustable and positionable fan powered by a front photo-voltaic cell array and a rear facing adjustable and positionable fan powered by a rear photo-voltaic cell array. The rear photo-voltaic cell array can also power an auxiliary smaller fan that cools the entirety of the photo-voltaic cells to maintain optimal efficiency. In environments where size is a concern, such as for example, in outdoor sporting events, graduations, concerts and the like, the present invention provides an alternative configuration wherein the rear platform and photo-voltaic cell array can disengage and slide underneath the front platform area to effectively curtail the footprint almost in half. The snake-like arms that connect the fan assemblies can be positioned down and out of the way leaving only the front portion of the headwear to cool the front area of the wearer, which in situations such as these, should be adequate. These advantages of maximizing efficiency of the solar power, providing flexibility of the fan arrays and dual modality of footprint have not heretofore been taught or suggested by the prior art Inventors have attempted to provide headwear incorporating personal fan cooling. For example, U.S. Pat. No. 4,893,356 titled, AIR CONDITIONED HEADWEAR HAVING CONVERTIBLE POWER MODULE which issued Jan. 16, 1990 discloses "headwear, including all forms of caps, hats, hard hats, visor type caps, to include a switchable power module capable of converting an electric motor driven air moving means from battery power to solar power wherein the solar power is removable."

In another example, U.S. Pat. No. 4,672,968 titled, HEADWEAR WITH BUILT-IN COOLING MEANS which issued Jun. 16, 1987 discloses, "[a] headpiece with two built-in fan units for cooling the face and back of the neck of a surgeon while he or she is performing surgery. Each of the fan units has a fan blade mounted perpendicularly within a cylindrical housing in close tolerance with the inner wall of the housing and includes an electric motor having a drive shaft to which the fan blade is attached. The motor and fan blade assembly is supported by vanes interconnecting it with the cylindrical housing which extend radially outwardly from the axis of the assembly. The headpiece has a frame that fits a wearer's head like a hat and supports the two fan units, one in front and the other in back of the frame. The frame also supports a power source for the two fan motors and other components of circuitry which permit adjustment of the speed of each motor for optimum cooling effect. The fan units are pivotally mounted and manually adjustable to different angular positions for control of the direction of airflow in front and back of the wearer's head."

In another example, U.S. Pat. No. 4,680,815 titled, SOLAR POWERED HEADWEAR FAN which issued Jul. 21, 1987 discloses, "[a] self contained personal cooling device. It is a one-piece modular component which is pre-wired and interchangeable between different hats. The components of the modular unit are employed in the unit to effect total body cooling by evaporation and forced convection. The unit is powered by photo-voltaic energy. The cooling effect of this modular device is maximized by incorporating air vent slots adjacent to the fan motor assembly to increase the force of air delivery."

In another example, U.S. Pat. No. 4,551,857 titled, HOT WEATHER HAT which issued Nov. 12, 1985 discloses, "[a] hot weather hat having a solar-powered Peltier-effect thermoelectric device mounted to a headpiece such that the cold surface of the thermoelectric device is in communication with the forehead of the wearer and the hot surface of the thermoelectric device is in communication with ambient atmospheric air. A thermally conductive strip provides conductive heat transport between the forehead and the cold surface. A finned radiator provides radiative and convective heat transport between the hot surface and ambient air."

In another example, U.S. Pat. No. 7,290,292 titled, COMBINED SOLAR POWERED FAN AND HAT ARRANGEMENT FOR MAXIMIZING AIRFLOW THROUGH THE HAT which issued Nov. 6, 2007 discloses "an apparatus includes a hat including a unitary brim that is provided with spaced inner and outer edges defining a slope traveling downwardly and outwardly towards the outer edge. The hat further includes a raised head region including a pair of spaced and coextensive apex regions and a trough intercalated therebetween. The hat has an oblong opening disposed at the rear of the head region for allowing air to flow outwardly from the head region at a rate equal to at least twice an inlet air flow rate. A motorized fan is mounted to a front side of the head region and subjacent to the trough. Solar panels are connected to a top surface of the brim. A sleeve is formed along an interior surface of the hat that extends from the solar panels and is connected to the fan for housing electrical leads coupled thereto.

In another example, U.S. Pat. No. 6,032,291 titled, SOLAR POWERED HEAD COOLING DEVICE which issued Mar. 7, 2000 discloses, "an apparatus for providing solar powered air circulation to the face and upper body of the user. A means for mounting photoelectric cells to the apex of the top of a hat is provided which cells are connected by wire to a directionally selective fan which is located under the brim of the hat. The fan receives air transmitted through a conduit under the brim of the hat which has its air inlets on the lateral edges of the brim of the hat. The fan is also provided with a horizontally movable axle means whereby it is partially rotatable in the horizontal axis to selectively distribute the air. An alternative embodiment is provided wherein the components of the present invention are assembled into a modular semi-flexible frame which can be attached to an existing favorite cap by means of hook and loop material thereby providing a portable cooling unit which can be easily attached to various hats In another example, U.S. Pat. No. 8,480,365 titled, CAP HAVING PIVOTBLY MOVABLE FAN which issued Jul. 9, 2013 discloses, "[an] article of headwear having a body with a hole extending completely through bottom and top surfaces thereof and a cooling device mounted to the article of headwear. The cooling device is mounted via a mounting ring received at the hole which mounts the cooling device to the body at the through hole to permit selective manipulation of the cooling device about a horizontal axis in a range between 0 to 360 degrees relative to the headwear body and the mounting ring."

There remains, therefore an unmet need for a device that provides power through optimized photo-voltaic cells to an independent and manipulable fan array such that the wearer has complete control over fan speed and positioning to provide ultimate cooling effects. Moreover, by providing a mounting surface and airflow and an optional third fan for additional cooling to the photo-voltaic cell surface, efficiency is optimized such that the solar power provides sufficient energy to power the entire array of cooling fans. Additionally, a dual modality is provided for instances where a sacrifice in power is an acceptable trade-off for a smaller footprint.

SUMMARY

The present invention provides a solution to the unmet need, by providing a device comprising:

a) a headwear;
b) a stabilizing mounting platform;
c) a photo-voltaic cell array;
d) an at least one repositionable fan and motor assembly;
   i) wherein said photo-voltaic cell array is optimized for efficiency by providing air circulation around said photo-voltaic cell array to minimize temperature; and
   ii) wherein said photo-voltaic cell array generates electric current to power said at least one repositionable fan and motor assembly through an electronic circuitry.

In one embodiment, the device of the present invention contains at least two repositionable fan and motor assemblies wherein one such assembly is mounted in a manner such that it can be positioned to easily fan the front of the wearer and another such assembly is mounted in a manner such that it can be positioned to easily fan the rear of the wearer.

In one embodiment, the device of the present invention further comprises a fan and motor assembly mounted such that it can be positioned to fan the photo-voltaic cell array to further cool the photo-voltaic cell array.

In one embodiment, the stabilizing mounting platform is mounted to the top of the headwear with at least one, and preferably three to five support struts to provide a minimum clearance of ½ inch of space between the headwear and the underside of the platform. One of skill in the art will appreciate that the space clearance is designed to provide air flow around the mounting platform to which the photo-voltaic cells are attached such that the temperature of such cells is minimized. Depending on the curvature of the headwear, the size of the mounting platform, the size of the actual photo-voltaic cell array implemented and the ambient conditions, such as ambient wind speed and temperature, such desired clearance may preferably vary anywhere from $1/64^{th}$ inch to 1 inch.

In one embodiment, the headwear could comprise a helmet of the style of a typical bicycle helmet. In an alternative embodiment, the headwear could comprise a baseball cap. In an alternative embodiment, the headwear could comprise any hat, cap, helmet or other head covering suitable to mounting a platform capable of attaching a photo-voltaic cell array and at least one personal cooling fan and motor assembly and the electronic circuitry required to harness the power of the photo-voltaic cell array and power the motor(s) of the personal cooling fan and motor assembly (s).

In one embodiment, the at least one personal cooling fan and motor assembly is attached to the headwear by way of a flexible snake like mounting arm with a sufficient hollow core to pass through the required electronic cabling to conduit the power generated by the photo-voltaic cell array to the motor of the personal cooling fan and motor assembly.

In one embodiment, the at least one personal cooling fan and motor assembly is attached directly to the stabilizing support platform by way of a flexible snake like mounting arm with a sufficient hollow core to pass through the required electronic cabling to conduit the power generated by the photo-voltaic cell array to the motor of the personal cooling fan and motor assembly. In an alternate embodiment, the least one personal cooling fan and motor assembly is attached directly to tabs incorporated into either the stabilizing support platform or the photo-voltaic cell array that is attached to the stabilizing support platform.

In one embodiment, the photo-voltaic cell array will be constructed from a light color material to minimize temperature and increase efficiency.

In one embodiment, the stabilizing mounting platform is five inches square. In another embodiment, the stabilizing platform is any size capable of supporting a side by side photo-voltaic cell array. For example, if a side by side photo-voltaic cell array is approximately 18 inches by 14 inches in a fully extended state, then it is preferable that the stabilizing support platform be 12 inches by 8 inches such that no more than 3 inches of photo-voltaic cell array overhangs the stabilizing support platform on any side.

In one embodiment, the stabilizing platform further comprises tabs to support and connect any of the personal cooling fan and motor assemblies and/or the smaller fan and motor assembly that cools the photo-voltaic cell array.

In one embodiment, the photo-voltaic cell array is eighteen inches square. In an alternative embodiment, the photo-voltaic cell array is of sufficient size to generate enough power to power the number of accessories attached in a given configuration. In one embodiment, the photo-voltaic cell array comprises a side by side array, and a front area and a rear area, the front area powering the front personal cooling fan assembly and the rear area powering the rear mounted cooling fan assemblies. Each side by side array is configured in a series of two by five photo-voltaic each connected in series and parallel with three by two cells attached to the front area of the support platform and two by two cells attached to the rear part of the support platform, each area connected but separable such that each area is capable of powering the fans in its respective areas and the rear area is capable of shutting off in certain circumstances while the front area remains operational. In this embodiment, the rear part of the platform is then capable of disengaging and sliding underneath the front portion when desired as described elsewhere herein. In this embodiment, when the rear platform is disengaged and slid underneath the front area, the front area connections are then completed to maintain circuitry integrity.

In one embodiment, both the stabilizing mounting platform and the attached photo-voltaic cell array further comprise a corresponding longitudinal hinge approximately centered such that the device can be folded for easy storage. In such an embodiment, the supporting struts are attached with a pivoting mechanism to allow the folding and the headwear either has a corresponding hinge to also fold or can be constructed from a collapsible material. In one embodiment, only the photo-voltaic cell array structure is hinged and folded while maintaining its attachment to the solid stabilizing mounting platform. This allows the entire device to have a smaller footprint for easy transportation.

In one embodiment, the photo-voltaic cell array is constructed in two side by side arrays wherein the rear part of the platform is capable of disengaging and sliding under the front part and out of the way when circumstances warrant, such as when full power is not required or when a sacrifice of power is a proper tradeoff for a smaller size.

In one embodiment, the side by side arrays of photo-voltaic cells are connected in series and parallel configurations.

In one embodiment, the personal cooling fan and motor assemblies are attached directly to the headwear.

In an alternative embodiment, the personal cooling fan and motor assemblies are attached to the stabilizing mounting platform.

In an alternative embodiment, the personal cooling fan and motor assemblies are attached either to the headwear directly and/or to the stabilizing mounting platform.

In an alternative embodiment, a rechargeable electric storage cell is provided to store charge gathered by the photo-voltaic cell array such that the device may be utilized in less than fully illuminated circumstances.

In one embodiment, the motor of the personal fan and motor assembly is a shunt wound DC powered motor.

In one embodiment, where the device comprises a photo-voltaic cell array cooling fan and motor assembly, such assembly is smaller than the personal cooling fan and motor assemblies. Additionally, this photo-voltaic cell array cooling fan and motor assembly is controlled by a capillary type thermostat calibrated to respond to extremely hot conditions of 80° F. or more which, when arriving at such predetermined temperature, the thermostat causes a switch to close which turns on this auxiliary photo-voltaic cell array cooling fan and motor assembly. In one embodiment, the preferred activation temperature may be 90° or slightly higher. The auxiliary cooling fan assembly is designed to cool the photo-voltaic cell array by 20° lower than ambient temperature. Where the photo-voltaic cell array maximum temperature is in the 110° to 115° area, then the preferred temperature to start the auxiliary fan would be 90° to 95°.

In one embodiment, any attached cooling fan and motor assembly may have a variable control speed rheostat switch such that the wearer may control whether any attached fan is on or off and at minimum to maximum speeds.

In one embodiment, various sections of the photo-voltaic cell array may generate power exclusively for any one fan and motor assembly. It may be desirable for the front personal cooling fan and motor assembly to have full capacity capability whether or not the user cares that the back personal cooling fan and motor assembly may be impacted by the concurrent use of the auxiliary photo-voltaic cell cooling fan and motor assembly.

In one embodiment, commercial, light-colored photo-voltaic cells approximately 3 to 3½ inches square will be connected in series to increase voltage output and then in parallel to increase current flow when mounted to the stabilizing mounting platform.

In one embodiment, a section of the photo-voltaic cell array may slide under the remaining sections to decrease the size of the exposed photo-voltaic cell array for use when conditions do not require maximum energy and size of the overall device is desired to be minimized.

In one embodiment, more than one section of the photo-voltaic cell array may slide under the remaining sections to further decrease the overall size.

In one embodiment, where sections of the photo-voltaic cell array slide under other sections of the photo-voltaic cell array, the sections are arranged on tracks that contain circuitry to maintain the integrity of the series and/or parallel electronic connections.

DETAILED DESCRIPTION

Figure 1:
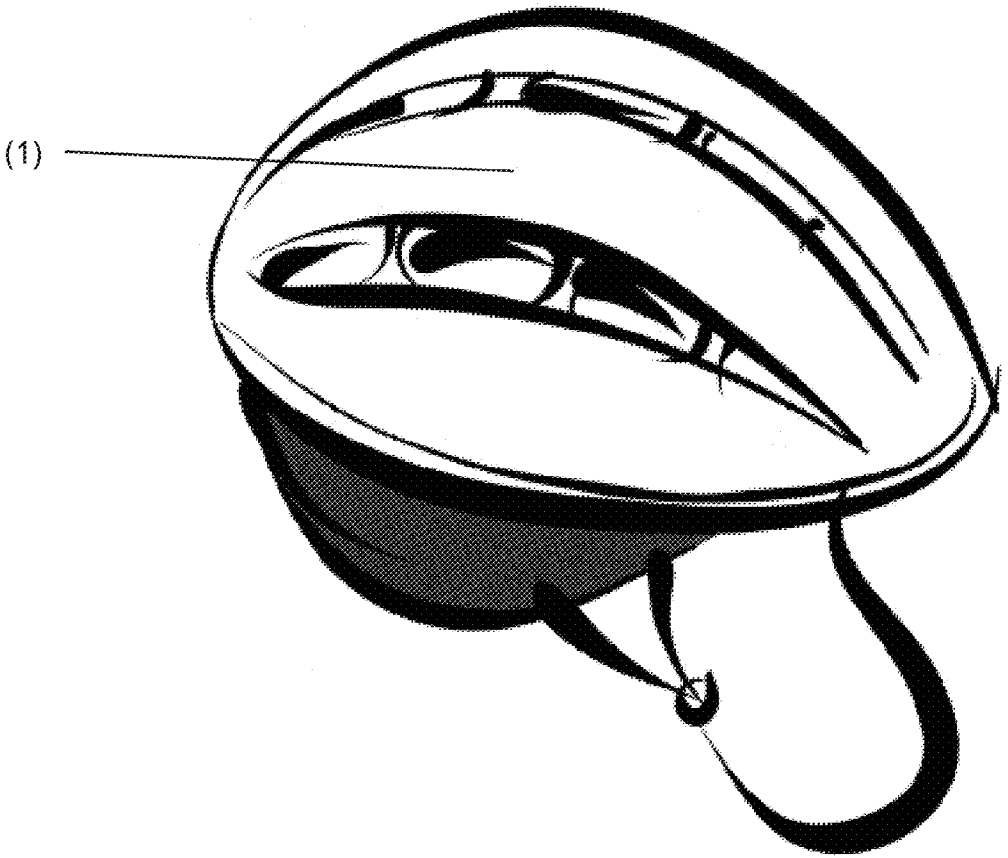
FIG. 1 depicts a typical headwear (1) suitable for use in one embodiment of the present invention.
Figure 2:
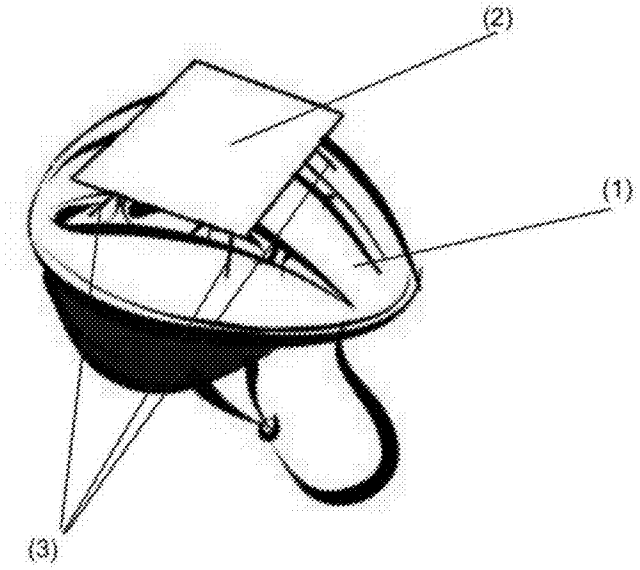
FIG. 2 depicts one embodiment of the device showing a stabilizing mounting platform (2) supported by mounting struts (3) attached to the headwear (1).
Figure 3:
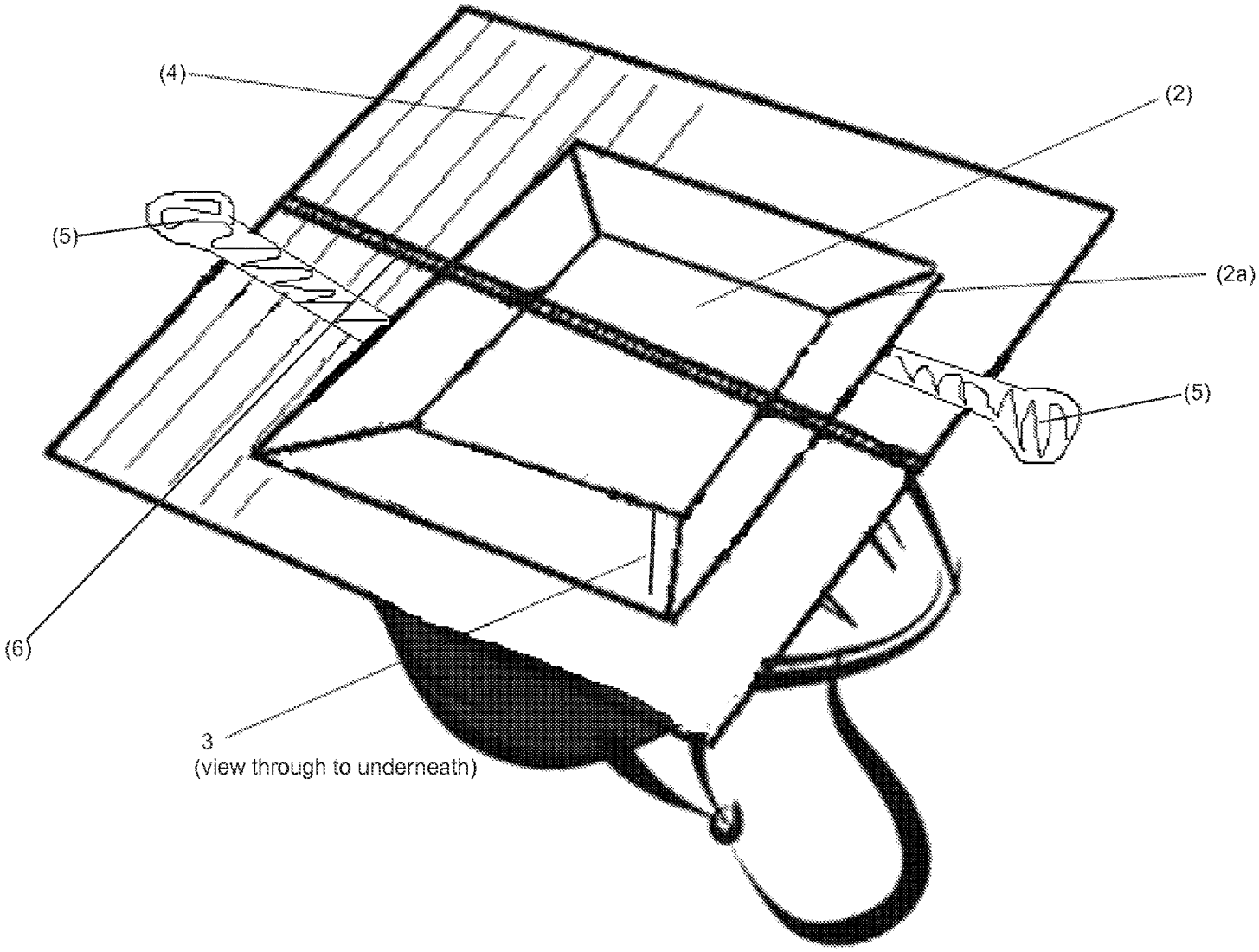
FIG. 3 depicts one embodiment of the device with a photo-voltaic cell array (4) mounted onto the stabilizing mounting platform (2) that is of a size sufficient to fully support the photo-voltaic cell array (4) and may thus extend outward in any direction as indicated by the extension lines (2*a*) and supported by mounting struts (3) attached to the headwear (1). Additionally, in one embodiment, the stabilizing mounting platform may have attached any number of mounting tabs (5) for supporting and attaching personal cooling fan assemblies (not shown). In one embodiment, the photo-voltaic cell array may also contain a hinge (6) to allow for folding.
Figure 4:
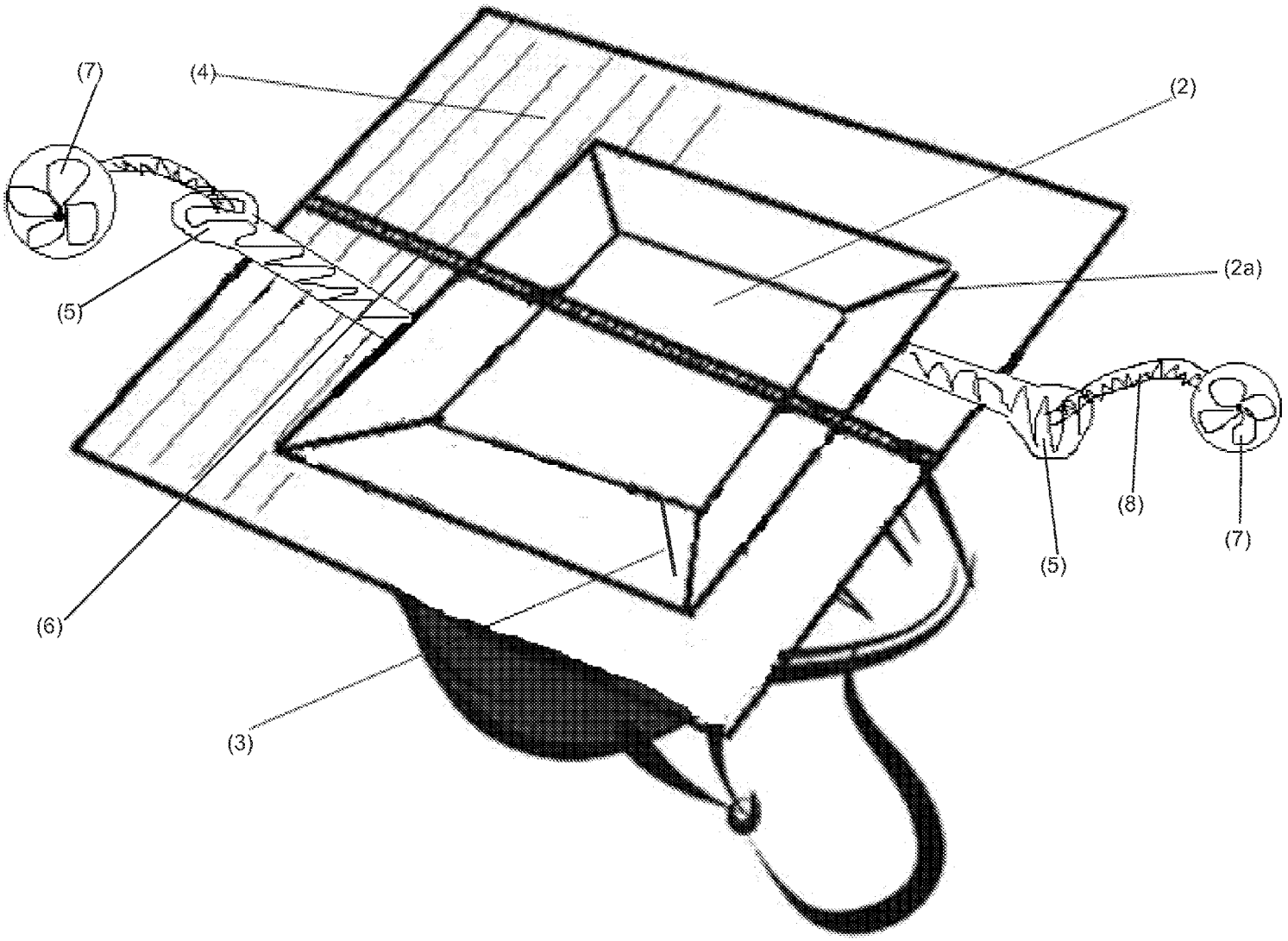
FIG. 4 depicts one embodiment of the device with two personal cooling fan assemblies (7) mounted to the headwear via tabs (5) mounted to the stabilizing mounting platform (2) with flexible and positionable snake-like mounting arms (8) and an electrical connection to the photo-voltaic cell array (not shown).
Figure 5:
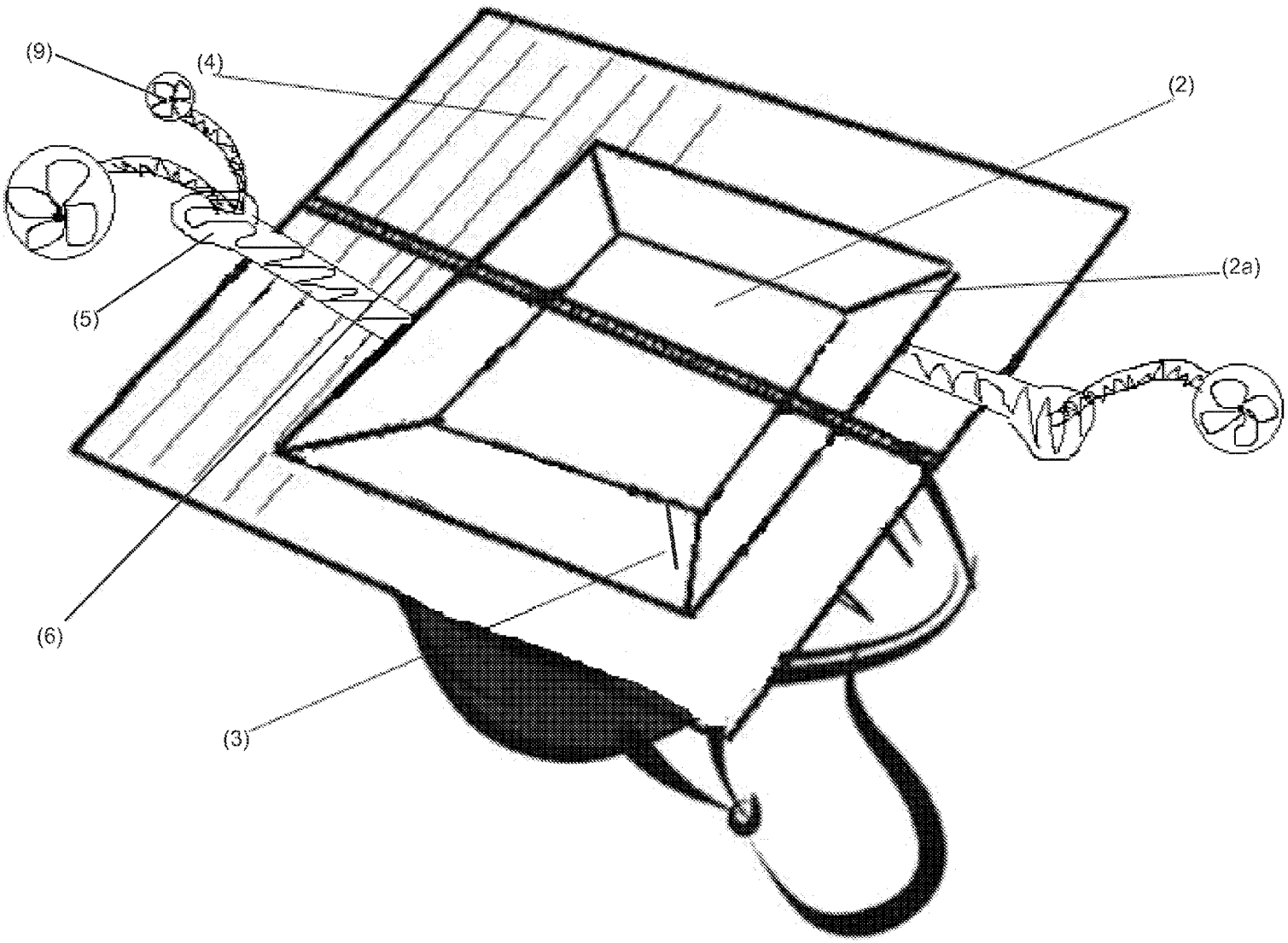
FIG. 5 depicts one embodiment of the device with a smaller cooling fan assembly (9) attached to a mounting tab (5) that is used to circulate air around the photo-voltaic cell array (4) to optimize its efficiency.
Figure 6:
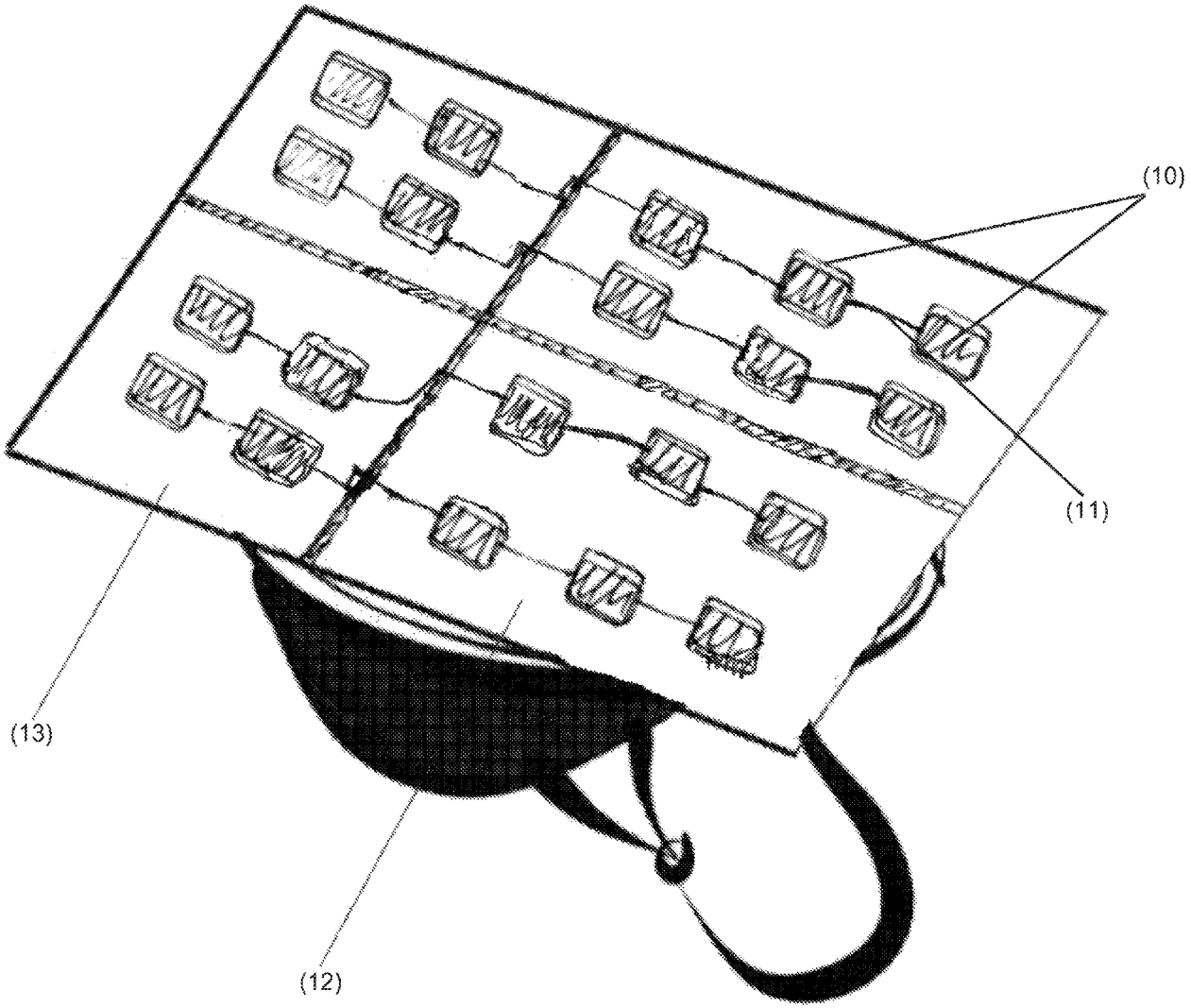
FIG. 6 depicts one embodiment of the device with a typical arrangement of individual photo-voltaic cells (10) in the overall photo-voltaic cell array having two sets of 5×2 cells interconnected in series (11) and with the further arrangement of a front area platform (12) and a rear area platform (13) wherein the rear area may disengage from the front area when desired and as explained in further detail elsewhere.
Figure 7:
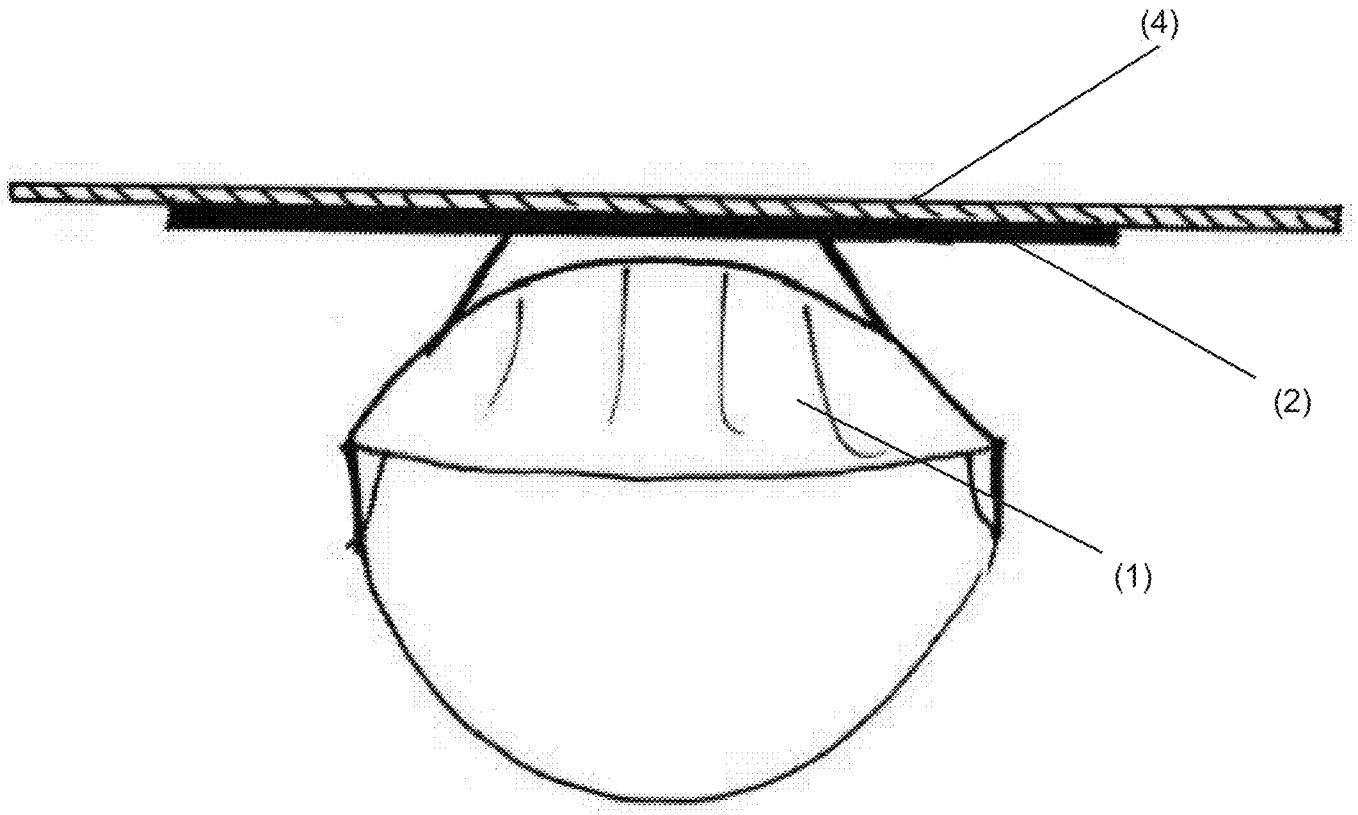
FIG. 7 depicts one embodiment of the device with a side view to demonstrate the clearances between the headwear (1), the stabilizing mounting platform (2) and the photo-voltaic cell array (4).
Figure 8:
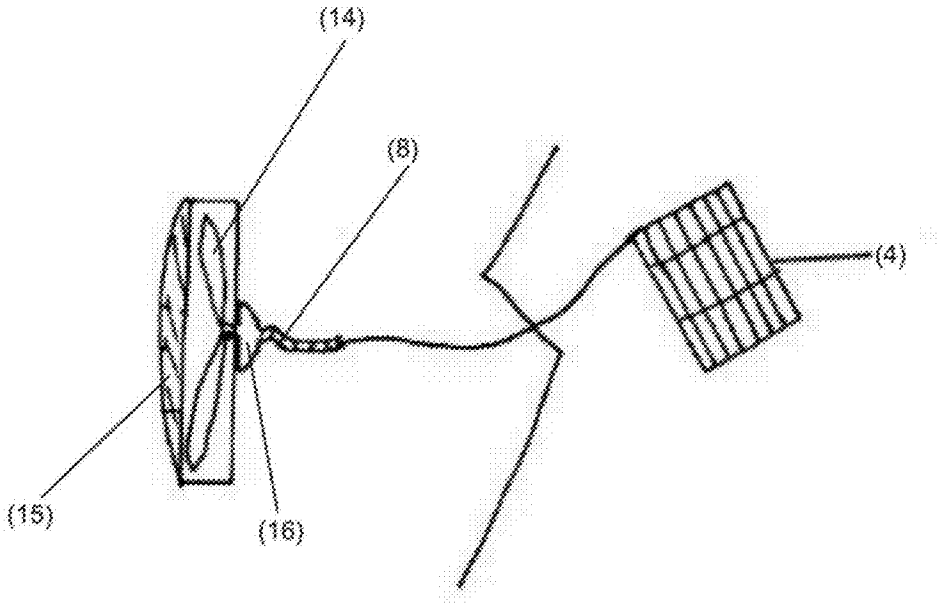
FIG. 8 depicts one embodiment of the device demonstrating a personal cooling fan assembly suitable for use wherein the blades of the fan (14) are housed in an enclosed cage (15) and powered by a shunt wound DC motor (16) fed energy through the snake like mounting arm (8) from the photo-voltaic cell array (4).
Figure 9:
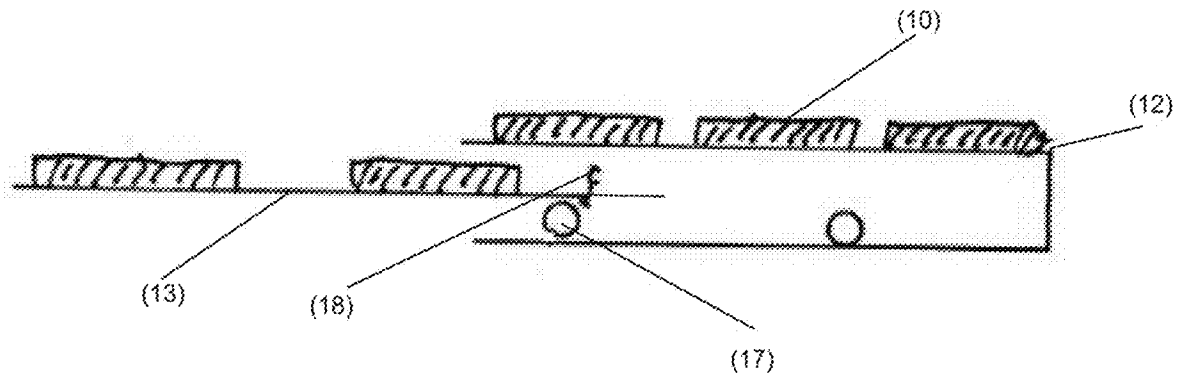
FIG. 9 depicts individual photo-voltaic cells (10) mounted on the front area platform (12) and rear area platform (13) wherein the rear area platform disengages and slides into a compartment that comprises a drawer mechanism underneath the front area platform on rollers (17) and secured by spring loaded latches (18).
Figure 10:
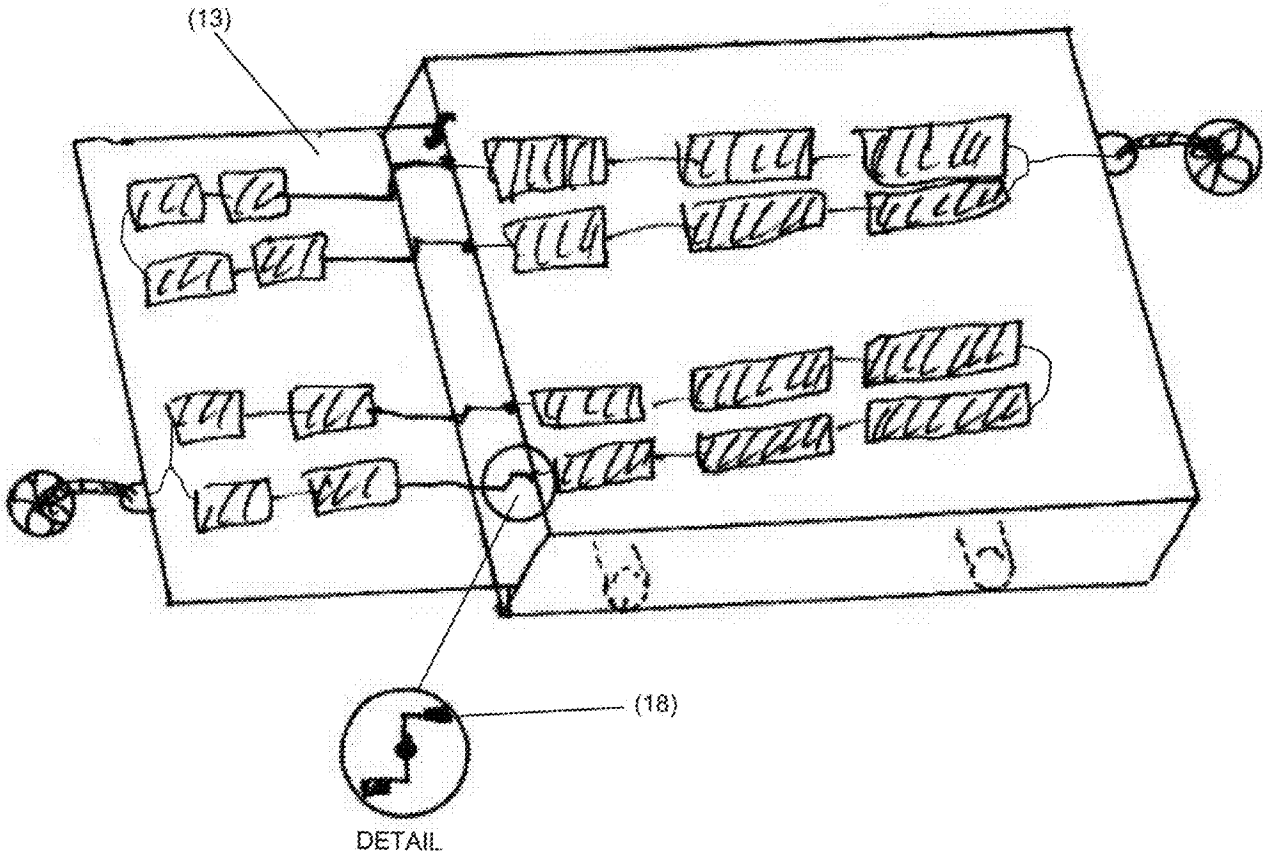
FIG. 10 depicts one embodiment of a drawer mechanism for housing the rear platform (13), in the open position being secured open by the spring loaded latch (18) and further depicting the side by side array of photo-voltaic cells that when in the open position are all fully functional.
Figure 11:
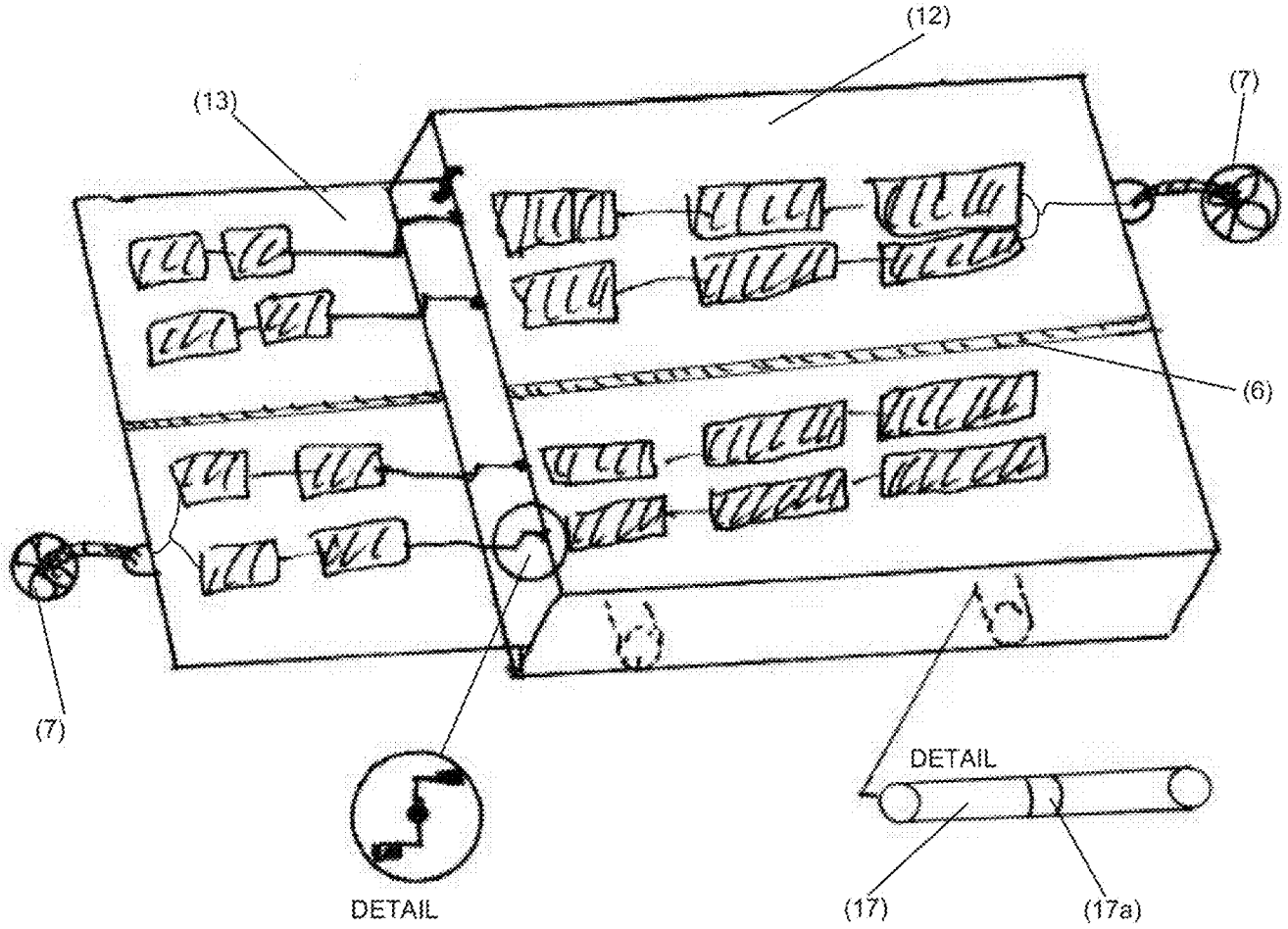
FIG. 11 depicts one embodiment of the device wherein two photo-voltaic cell arrays of five cells by two cells connected in series and in parallel, one front assembly of two sets of 3×2 photo voltaic cell arrays (12) that power a front cooling fan assembly (7) and one rear assembly of two sets of 2×2 photo-voltaic cell arrays (13) that power a rear cooling fan assembly (7) (and potentially a smaller photo-voltaic cooling fan assembly (not shown)) wherein the rear area cell array is capable of disengaging and sliding underneath the front area cell array on rollers (17). Additionally, in one embodiment, the entire structure may be hinged (6) such that it can be folded for transport (including the rollers, which may comprise separated or separable individual rollers (17*a*)).
Figure 12:
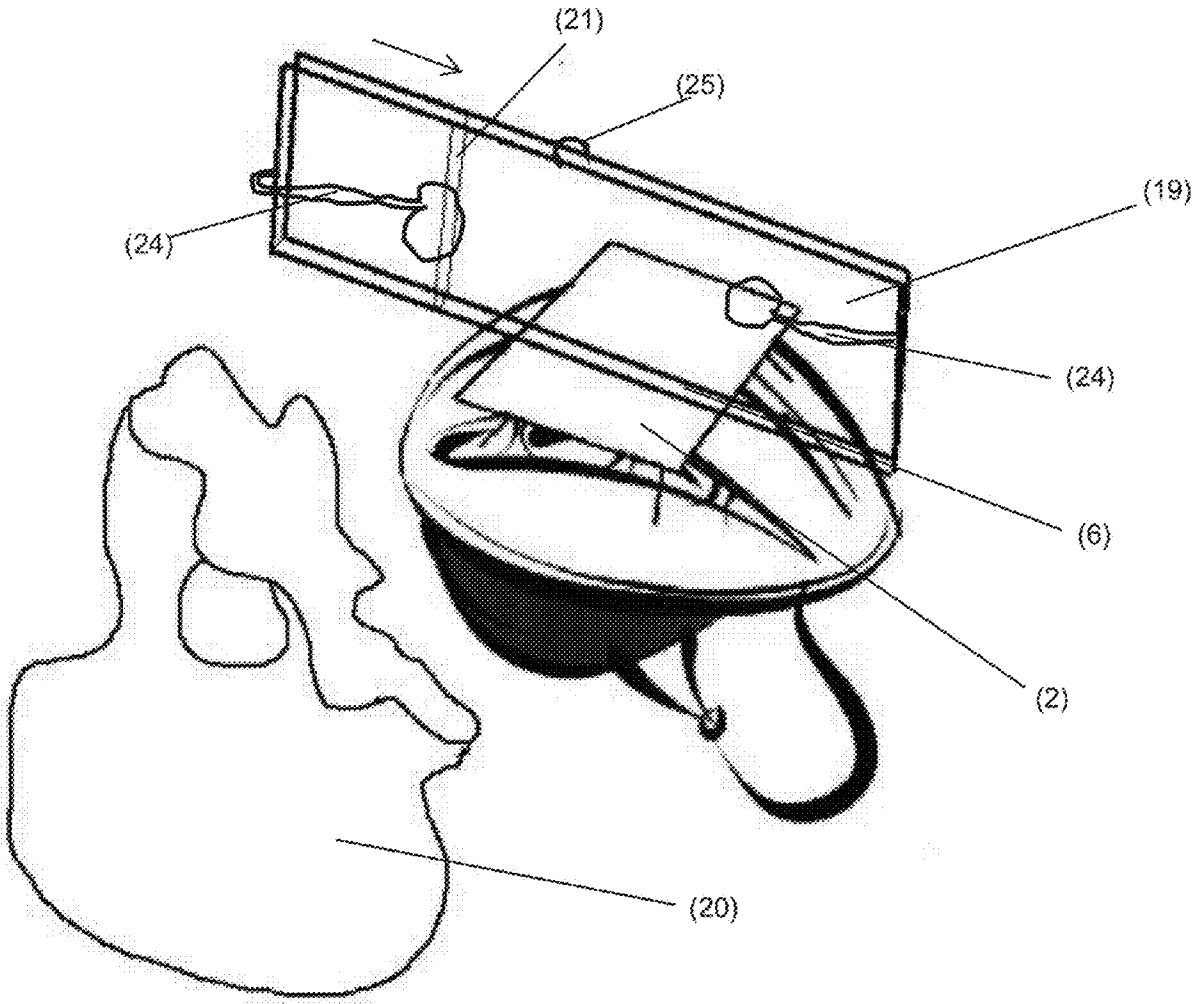
FIG. 12 depicts one embodiment of the device wherein the photo-voltaic cell array structure is folded (19) but remains attached to the mounting platform (2) at the hinge (6) and is thus easier to transport in a carry bag or backpack (20). In this depiction, the photo-voltaic cell array is still extended, the rear area array out from the front area array (21), but may be closed first prior to folding to become even more compact. When folded, because the fans are mounted with moveable snake-like arms, they are folded flat against the folded structure (24). Once folded closed, in one embodiment, a latch may be used to secure the device in the folded position (25).
Figure 13:
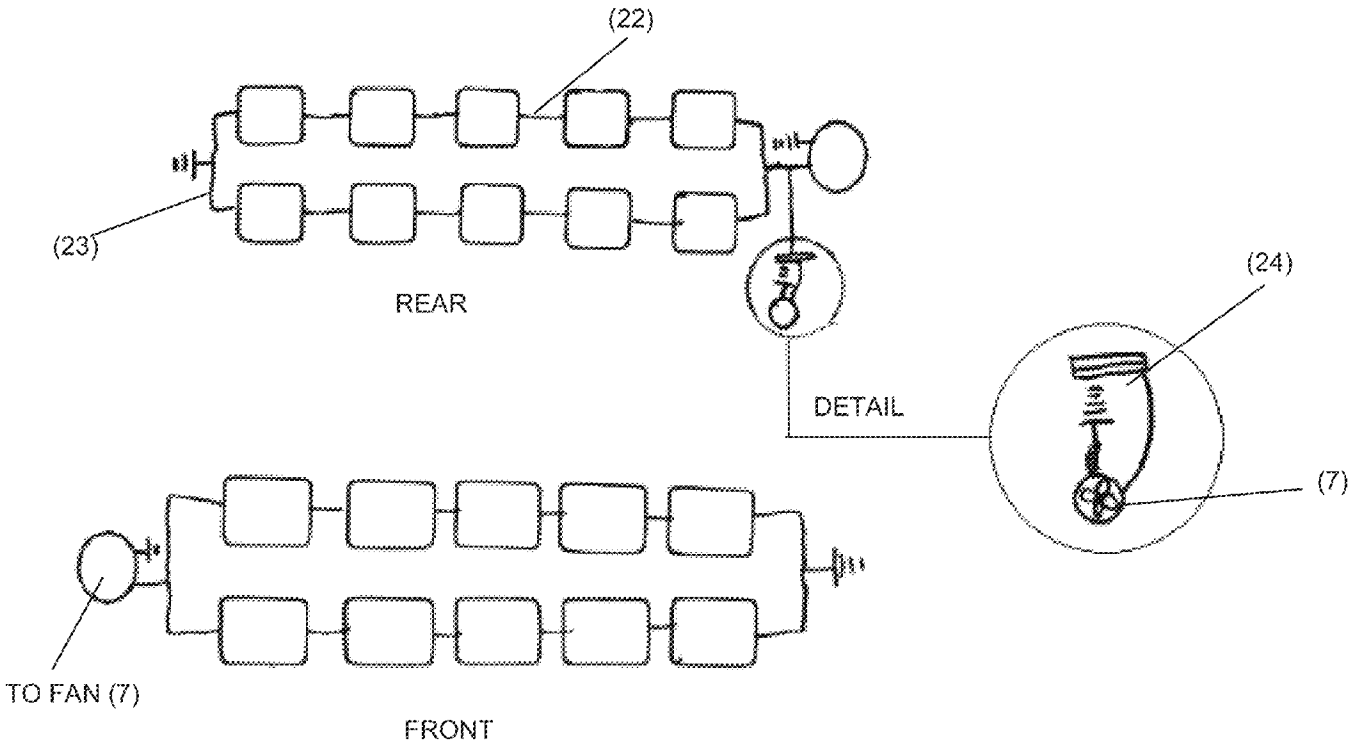
FIG. 13 depicts a photo-voltaic cell array of five cells by two cells connected in series (22) and in parallel (23), one front assembly depicting the connection to a front cooling fan assembly (7) and one rear assembly. An automatic capillary style thermostat switch (24) can be used to activate any fan. Both arrays depict the use of individual photo-voltaic cells capable of producing 0.60 volts at 2 amps for a power output of 1.2 watts or 12 watts total to power a DC shunt wound motor via a switch, with the rear array further encompassing a thermostat switch for the auxiliary cooling fan (7).
Figure 14:
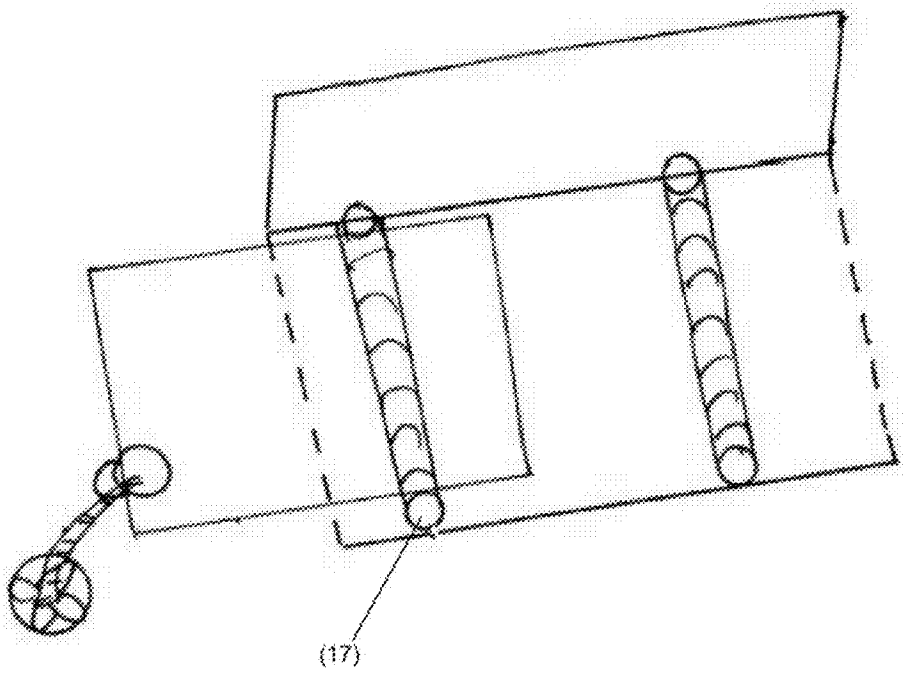
FIG. 14 depicts a cut away view of one embodiment of the drawer mechanism showing the rear portion sliding in or out on rollers (17), which may be split for folding.
Figure 15:
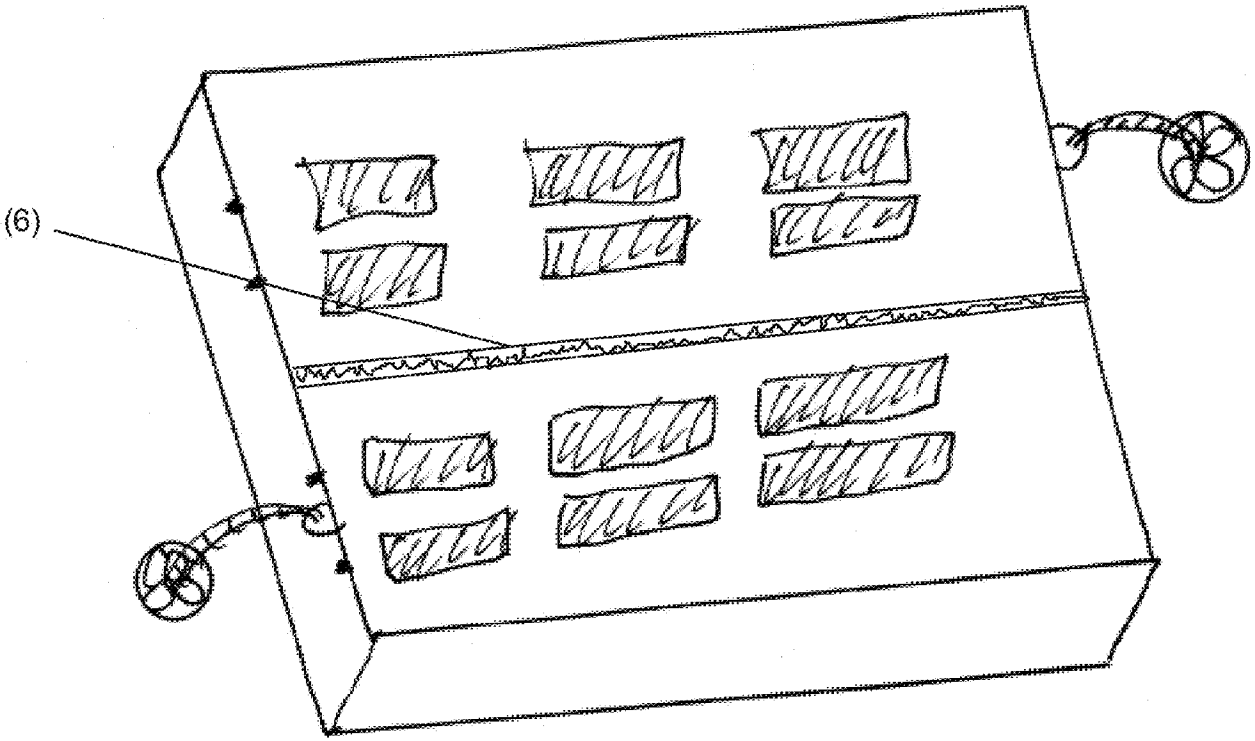
FIG. 15 depicts one embodiment of the photo-voltaic cell arrays in the drawer configuration with the drawer in the closed position and taking off-line the rear area photo-voltaic cell array. In one embodiment, electrical connectors protrude slightly such that they are capable of connecting with the rear photo-voltaic cell array when pulled out. Also depicted is the hinge (6), in some embodiments, allowing the entire structure to be folded for transport as indicated elsewhere.
Figure 16:
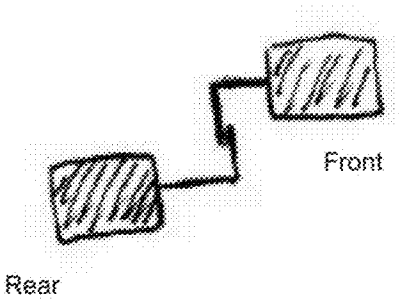
FIG. 16 depicts one embodiment of the connection of the photo-voltaic cell circuitry depicting the front photo-voltaic cells maintaining electrical integrity with the rear photo-voltaic cells when the drawer is in the open position.

For clarity of disclosure, and not by way of limitation, the detailed description of the invention is divided into the following subsections that describe or illustrate certain features, embodiments or applications of the present invention.

Definitions

"Photo-voltaic cell" as used herein means a device that converts the energy of light directly into electricity by the photo voltaic effect through the absorption of light generating either electron-hole pairs or excitons, the separation of charge carriers of opposite types and the separate extraction of those charge carriers to an external circuit.

"Cooling fan and motor assembly" as used herein means any self contained propelled fan blade assembly powered by an electric motor capable of being powered by electric charge generated by a photo-voltaic cell.

The Device of the Present Invention

One embodiment of the device of the present invention comprises:

a) a headwear;
b) a stabilizing mounting platform;
c) a photo-voltaic cell array;
d) an at least one repositionable fan and motor assembly;
   i) wherein said photo-voltaic cell array is optimized for efficiency by providing air circulation around said photo-voltaic cell array to minimize temperature; and
   ii) wherein said photo-voltaic cell array generates electric current to power said at least one repositionable fan and motor assembly through an electronic circuitry.

In one embodiment, the device of the present invention utilizes commercially available photo-voltaic cells of 3.3 inches square and arranges them on a dual platform in two 5×2 rows, one such 5×2 array on the one side of the platform and the second such 5×2 array on the other side of the platform.

In this embodiment, the front three of the 5×2 array is separate from the rear two or the 5×2 array such that the when the rear part of the platform disengages and slides underneath the front portion in a drawer like fashion, the rear portions of the side by side photo voltaic cell arrays are taken off line. The front powering array powers the front fan and the rear powering array powers the back fan and any other auxiliary fan, such as the smaller photo-voltaic cell array cooling fan, if present. However, when the rear portion of the platform is disengaged, the rear and auxiliary fans are then disengaged from power and are inoperative. In this embodiment, the front area array circuitry is completed via a circuit engagement. However, the size of the overall platform is substantially reduced to almost half of its original size configuration.

In the open position, where there are two 5×2 cell arrays made from 3.3 inch square individual photo-voltaic cells, the platform is approximately 17 to 18 inches by 14 to 14½ inches. When in the closed position, the latter dimension is reduced to 10 inches or less.

Each 3.3 inch square photo-voltaic cell individually is capable of producing 0.60 volts at 2 amps for a power output of 1.2 watts. When connected in parallel and series, the total output from 10 cells is thus 12 watts which is sufficient to fully operate a personal shunt wound dc motor cooling fan assembly.

The front powering photo-voltaic cell array attached to the front part of the platform is always exposed and connected to the front personal cooling fan and motor assembly and is always on line. The rear powering photo-voltaic cell array attached to the rear part of the platform is only operational in the open position. When in the open position, it is kept open with a spring loaded latch that operates to catch the top of the front platform and preventing the rear platform from sliding. When the closed position is desired, the spring loaded catch is depressed releasing the rear platform, which can then slide into its drawer underneath the front platform on rollers and a second spring loaded catch secures the rear platform in place in the closed position. In the closed position, the photo-voltaic cell array on the rear platform is disengaged from the circuitry and can no longer power the rear and/or auxiliary cooling fan assemblies.

EXAMPLES

In a preferred embodiment, the device of the present invention utilizes a stabile headwear, such as with a typical bicycle helmet with aerating vents and of a suitable material to enable a stabilizing support platform, photo-voltaic cell array and cooling fans to be attached and manipulated.

In a preferred embodiment, there are two separate photo-voltaic cell arrays in a side by side configuration attached to both a front platform and a rear platform, such that the rear platform is capable of disengaging and sliding underneath the front platform. The front platform will have twelve 3.3 inch square individual photo-voltaic cells arranged in a double 3×2 array and connected in series and parallel and the rear platform will have eight 3.3 inch square individual photo-voltaic cells arranged in a double 2×2 array and connected in series and parallel to generate a total of 12 watts of power. One side is connected to one front facing personal cooling fan and motor assembly with a rheostat control switch to adjust the speed of the fan. The other side is connected to a rear personal cooling fan and motor assembly and a smaller device cooling fan and motor assembly. However, in situations where space is at a premium, such as a public event, and movement is at a minimum, again such as when seated at a public event, it may be desirable to only operate the front fan and save space by sliding the rear platform into the closed position as described elsewhere herein. By doing so, the rear photo-voltaic cells become disengaged from the overall circuitry and no longer generates power. The connected rear facing and auxiliary fans become disengaged.

In a preferred embodiment, when the rear platform is open and the device is fully powered and operational, the smaller fan assembly that cools the photo-voltaic cell platforms to maximize power generated therefrom, is controlled by a capillary style thermostat switch such that that fan is only operational above a certain programmable temperature. All of the fans may have on/off switches and/or rheostat speed controls for ultimate user control.

In a preferred embodiment, the photo-voltaic cell array will contain rounded edges and soft corners to insure that anyone coming in contact with the device of the present invention will not be injured by sharp corners or edges. Additionally, the entire edge of the device of the present invention may contain a soft material such as a neoprene or rubber or foam or foam-like material to further soften and cushion any contact with its edges.

Each and every feature described herein, and each and every combination of two or more of such features, is included within the scope of the present invention provided that the features included in such a combination are not mutually exclusive.

What is claimed is:

1. A device comprising:

a headwear comprising front and rear portions;

a stabilizing mounting platform mounted to the headwear; and a photo-voltaic cell array platform having a photo-voltaic cell array comprised of a front photo-voltaic cell array and a rear photo-voltaic cell array disposed on the photo-voltaic cell platform, and the photo-voltaic cell array platform being configured to be mounted to the stabilizing mounting platform, the photo-voltaic cell array platform defining front and rear array platform portions respectively corresponding to the front and rear portions of the headwear, and wherein the front and rear array platform portions, respectively, are disposed on the corresponding front and rear arrays of the photo-voltaic cell array;

a plurality of fan assemblies comprising a front array fan assembly operatively connected with the front array and configured to direct an air flow from an area adjacent the front portion of the headwear toward a wearer of the headwear, a rear array fan assembly operatively connected with the rear array configured to direct an airflow from an area adjacent the rear portion of the headwear toward the wearer of the headwear, and an auxiliary fan assembly operatively connected with the photo-voltaic cell array and configured to direct an airflow to the photo-voltaic cell array, wherein the photo-voltaic cell array is configured to be operable in first and second modes, in which in the first mode, the front and rear arrays are aligned and configured to, respectively, supply power to the front array fan assembly, the rear array fan assembly and the auxiliary fan assembly, and in which in the second mode, each of the front and rear arrays are misaligned such that the rear array platform portion, the rear array and rear array fan assembly are disposed beneath the front array platform portion, the front array and the front array fan assembly, such that the rear array platform portion and the rear array are disposed within a compartment of the photo-voltaic cell array platform, the disposition of the rear array beneath the front array rendering the rear array inoperable to supply power, and the auxiliary fan assembly is configured to be automatically operable, in response to sensing of an occurrence of a predetermined temperature of the photo- voltaic cell array, to direct an airflow toward at least one of the front and rear arrays of the photo-voltaic cell array.

2. The device of claim 1 wherein the auxiliary fan assembly comprises a capillary thermostat configured to obtain the sensing of the occurrence of the pre-determined temperature of the photo-voltaic cell array and enable automatic operation of the auxiliary fan.

3. The device of claim 1 wherein the stabilizing mounting platform comprises a one-piece construction forming edge portions of the stabilizing mounting platform, in which the edge portions comprise foam or rubber.

4. The device of claim 1 wherein the stabilizing mounting platform comprises one or more mounting tabs, wherein each of the one or more mounting tabs is configured to attach a respective one of the plurality of fan assemblies to the stabilizing mounting platform.

5. The device of claim 1 wherein each of the plurality of fan assemblies comprises a motor.

6. The device of claim 5 wherein each of the plurality of fan assemblies is configured to be controlled by a switch determining respective operational status of the motor, and speed of each of the plurality of fans.

7. The device of claim 6 wherein each of the plurality of fan assemblies is configured to be flexibly mounted with respect to the stabilizing platform so as to be positionable toward or away from the stabilizing platform.

8. The device of claim 1 wherein the compartment of the photo-voltaic cell array platform comprises a drawer.

9. The device of claim 8 further, wherein the compartment of the photo-voltaic cell array comprises rollers disposed within the drawer, and is configured to receive the rear array platform portion, and the rear array.

10. The device of claim 9 wherein the photo-voltaic cell array comprises a hinge enabling folding of the photo-voltaic cell array.

11. The device of claim 1 wherein the photo-voltaic cell array comprises a hinge enabling folding of the photo-voltaic cell array.

* * * * *